US012680698B2

(12) United States Patent
Horst et al.

(10) Patent No.: US 12,680,698 B2
(45) Date of Patent: Jul. 14, 2026

(54) OPTICAL ASCERTAINMENT OF OPERATING STATES OF A COOKTOP

(71) Applicant: BSH Hausgeräte GmbH, Munich (DE)

(72) Inventors: Gerald Horst, Karlsruhe (DE); Frank Schaefer, Puchheim (DE); Daniel Vollmar, Pfinztal (DE)

(73) Assignee: BSH Hausgeräte GmbH, Munich (DE)

( * ) Notice: Subject to any disclaimer, the term of this patent is extended or adjusted under 35 U.S.C. 154(b) by 812 days.

(21) Appl. No.: 18/019,256

(22) PCT Filed: Jul. 21, 2021

(86) PCT No.: PCT/EP2021/070361
§ 371 (c)(1),
(2) Date: Feb. 2, 2023

(87) PCT Pub. No.: WO2022/037886
PCT Pub. Date: Feb. 24, 2022

(65) Prior Publication Data

US 2023/0288073 A1 Sep. 14, 2023

(30) Foreign Application Priority Data

Aug. 18, 2020 (DE) ..... 102020210482.4

(51) Int. Cl.
*F24C 7/08* (2006.01)

(52) U.S. Cl.
CPC ..... *F24C 7/083* (2013.01)

(58) Field of Classification Search
CPC ..... F24F 7/083; F24C 15/2021; F24C 15/20
See application file for complete search history.

(56) References Cited

U.S. PATENT DOCUMENTS

2018/0224127 A1* 8/2018 Lambert ..... H05B 1/0266
2019/0277509 A1 9/2019 Hildner

FOREIGN PATENT DOCUMENTS

EP 2527747 A1 11/2012

OTHER PUBLICATIONS

International Search Report PCT/EP2021/070361 dated Oct. 15, 2021.

* cited by examiner

*Primary Examiner* — Ko-Wei Lin
(74) *Attorney, Agent, or Firm* — Michael E. Tschupp; Andre Pallapies; Brandon G. Braun

(57) ABSTRACT

In a method for optical ascertainment of an operating state of a cooktop, objects are optically detected within a detection space including the cooktop with at least two cooking zones and a control panel with at least two identifiers. The cooking zones and the identifiers are recognized based on optically detected properties of the objects. A centroid for each object is determined and the cooking zones and the identifiers are arranged based on detected coordinates of the respective centroids in the detection space. The identifiers are assigned to a respective cooking zone based on the arrangement of the cooking zones and the identifiers, and an operating state for at least one cooking zone is ascertained based on a detected unambiguous feature of one of the identifiers assigned to the at least one of the cooking zones.

20 Claims, 4 Drawing Sheets

OPTICAL ASCERTAINMENT OF OPERATING STATES OF A COOKTOP

CROSS-REFERENCES TO RELATED APPLICATIONS

This application is the U.S. National Stage of International Application No. PCT/EP2021/070361, filed Jul. 21, 2021, which designated the United States and has been published as International Publication No. WO 2022/037886 A1 and which claims the priority of German Patent Application, Serial No. 10 2020 210 482.4, filed Aug. 18, 2020, pursuant to 35 U.S.C. 119 (a)-(d).

The contents of International Application No. PCT/EP2021/070361 and German Patent Application, Serial No. 10 2020 210 482.4 are incorporated herein by reference in their entireties as if fully set forth herein.

BACKGROUND OF THE INVENTION

The present invention relates to a method for optical ascertainment of an operating state of a cooktop and a control apparatus.

Cooktops of the current generation often have the option of exchanging data with other appliances and to this end can be integrated, for example, in a network. Via corresponding protocols, therefore, the current status of the cooktops can be communicated to other appliances, for example, so that a power adjustment can be initiated if required. Such an exchange of data is limited, however, to compatible combinations of the cooktop with another appliance, for example an extractor hood or a separate evaluation apparatus.

Moreover, older cooktops often do not have the appropriate connection and thus do not provide an option for detecting operating states of the cooktop or the respective cooking zones so that useful applications such as power controls, safety measures or an anticipatory assistance of other appliances in a cooking system on the basis of the operating state are excluded.

BRIEF SUMMARY OF THE INVENTION

It is thus the object of the present invention to provide a solution which at least reduces the above drawbacks. Preferably, an option is achieved here which provides a detection and evaluation of operating states of cooking zones of a cooktop by other appliances in the absence of an exchange of data, in order to permit thereby an integration of cooktops in cooking systems.

This object is achieved according to the invention by a method for optical ascertainment of an operating state of a cooktop. The method comprises the following steps:

- optically detecting objects within a detection space, wherein the detection space comprises the cooktop with at least two cooking zones and a control panel with at least two identifiers,
- recognizing the cooking zones and the identifiers on the basis of the optically detected properties of the objects;
- determining a centroid for each detected object and arranging the cooking zones and the identifiers on the basis of detected coordinates of the respective centroids in the detection space;
- assigning the identifiers to one respective cooking zone on the basis of the arrangement; and
- ascertaining an operating state for at least one cooking zone on the basis of a detected unambiguous feature of one respective assigned identifier.

The optical detection can be carried out, for example, by a detection unit which permits an optical and contactless detection, for example in the form of a camera. The detection unit is arranged in this case such that the cooktop and the control panel thereof are located entirely in a detection space or detection range of the detection unit. The detection unit can be provided, for example, as a unit of a control apparatus which can also be denoted and configured as a module and, in particular, as a PAI module (Projection and Interaction Module). Such a control apparatus can be correspondingly integrated in an extractor hood or designed as a separate appliance. In the last case, the control apparatus is arranged at a similar height to an extractor hood above the worktop and preferably the cooktop. The control apparatus can also be coupled to an alternative extractor apparatus, such as a table fan or downdraft fan, wherein for example (only) the detection unit is separately arranged.

In this manner, for the optical detection, relevant objects can be detected and evaluated in order to identify or recognize cooking zones and identifiers. The recognition of such objects can be carried out, for example, using object recognition algorithms on the basis of one or more images. Preferably, the detection and the recognition of the objects take place during the initial operation, wherein no objects are placed or arranged on the cooktop, in order to permit a clear and unambiguous recognition of the objects thereby.

The cooktop can have at least two cooking zones. Preferably, however, the cooktop has between three and six cooking zones, wherein the arrangement on the cooktop can be symmetrical or asymmetrical. A corresponding number of identifiers, which are also denoted as indicators and can comprise respective toggles, rotary knobs or displays or partial displays, is located in the detection space. Correspondingly, the identifiers are control elements and/or indicators which indicate the respective operating state and/or are designed to set the respective operating state of a corresponding cooking zone.

One respective centroid for the recognized objects or the cooking zones and identifiers is determined on the basis of coordinates in the detection space. In other words, a central point for the respective object is established so that a relative arrangement can be predetermined in order to define a central focal point and an optional region which can be used, for example, for monitoring a cooking process or a cooking system.

The number and type of recognized objects are stored and sorted on the basis of the centroids so that a relative arrangement is provided. For example, the data can be kept in lists and thus stored for future cooking processes, wherein each cooking zone can be assigned to one respective centroid on the basis of the list and each identifier can be correspondingly assigned to a corresponding respective centroid on the basis of the list.

Thus a relative arrangement of the cooking zones and identifiers is permitted by means of corresponding detected coordinates in the detection space. The identifiers are assigned to one respective cooking zone on the basis of the arrangement or on the basis of a list, so that a link is provided between each identifier and one respective cooking zone. In other words, on the basis of the arrangement it is established which identifier corresponds to one respective cooking zone, for example on the basis of stored empirical values and/or a predetermined assignment and sequence of the list.

An operating state of the respective cooking zones can be ascertained by the assignment on the basis of the identifiers or the indicators, wherein each identifier comprises one or more unambiguous features for the respective operating states which can be detected by a detection unit and evaluated or recognized. As a result, an evaluation of the operating states of the respective cooking zones is permitted, so that cooking processes and a cooking system as such can be correspondingly monitored.

For example, a warning signal can be output on the basis of a determined operating state, for example a visual signal, for example in the form of at least one lighting means, and/or an acoustic signal, for example in the form of a buzzer or similar apparatus. Thus a user can be made aware of a current state of the cooktop or a specific cooking zone.

In this manner, the safety of the use of a cooking system, and in particular a cooktop, can be improved. For example, it can be recognized that a cooking zone is switched on but a cooking vessel is not located on the cooking zone and/or a user is not present or the cooktop is not located in the field of view of the user. Thus a user can be made aware of an imminent danger, for example, so that a potential hazard can be prevented in good time.

Cooking processes can also be anticipated thereby, wherein a control signal and/or regulating signal is preferably output, for example, in order to adjust a corresponding power or fan stage of an extractor apparatus to the determined operating state. Additionally or alternatively, an assistance function can also be implemented, wherein for example recipes are stored and an actual value of an ascertained operating state is compared with a reference value for a recipe step, wherein cooking instructions and corresponding settings are preferably displayed and stored. In this manner, a notice can also be output when an event is imminent and, for example, a next step is to be initiated.

The notice or the warning signal can also comprise an information output and/or a notification to the user. A user can be correspondingly notified in the absence of a cooking process. For example, a warning signal or the information output or notification can be transmitted by means of WIFI (direct), Bluetooth, radio frequency (RF), infrared signal, a "hood-hob-connect" or even via an existing internet connection such as HCA or Home Connect to a coupled terminal device of the user, preferably via a preinstalled app which receives this notification in the background periodically or by means of push notifications or, in the active state, continuously.

Correspondingly, it is possible that different processes can be monitored and/or anticipated by the optical detection of the operating state without data being transmitted from a cooktop for this purpose.

Preferably a set heat setting, a change and/or a progression of the heat setting or the presence of residual heat is ascertained as an operating state. A heat setting or a change of the heat setting or the operating state thus can be ascertained by the detection unit which is configured, for example, as a camera and assigned to one respective cooking zone.

A progression can also be displayed and evaluated on the basis of the current operating state and/or a change of the operating state in order to determine a more accurate ranking of a current state of the cooking zone and a potential risk resulting therefrom and/or a heat emanating therefrom and to take this into consideration, if required, when outputting a signal.

Moreover, it can be provided that a current temperature of the cooking zone is ascertained on the basis of the ascertained operating state. As described above, for example, a progression of the operating state or an operating state change can be displayed so that a corresponding energy supply or an existing (residual) heat of the cooking zone can be determined on the basis of stored values and a temperature can be concluded therefrom. The temperature or an abstraction thereof can be used for determining a potential risk, for example for ranking or classifying a potential danger. The temperature can also be compared with a stored predetermined temperature and/or indicate a correspondingly preferred power of an extractor apparatus, so that a corresponding signal can be output or an adjustment to the power can take place or even a warning signal can be output as a function of the ascertained temperature.

The feature for recognizing the operating state can also comprise a structural feature and/or displayed information. For example, a structural feature can be provided in the form of a specific projection on an identifier or control element or toggle. Alternatively or additionally, the feature can be illustrated or printed on the identifier, for example, when it is a heat setting. The control panel can, however, also be configured with touch sensors and one respective display for each cooking zone, wherein in such an embodiment the feature is preferably detected as a graphic representation, for example by means of a seven-segment display.

For recognizing the cooking zones and the identifiers, the optically detected properties of the objects can comprise, for example, a contrast, a contrast gradient, markings, boundary lines, edges and/or a size of the object. Correspondingly, for example, values which indicate specific objects and facilitate a differentiation of the objects can be stored. Such properties can be implemented, for example, in an object recognition algorithm. In this manner, it is not only possible to detect and recognize cooking zones and identifiers or indicators or control elements but also cooking vessels, cooking utensils and/or cookware.

For example, the objects can be recognized on the basis of the shape, for example by edge recognition or recognizing a border or even straight lines which differ from biometric features. Depth images can be detected to assist this, in order to be able to determine for example a three-dimensional shape. Moreover, infrared images can also be detected, whereby for example a type of material or a classification of materials can be concluded and/or a specific density ascertained or even a reflection can be detected for assisting the object recognition.

The arrangement which is based on the detected coordinates can take place on the basis of a coordinate system, wherein the detection unit comprises, for example, a coordinate origin or a reference point which permits a relative positioning of detected object points and centroids. The origin can, for example, be a central point which coincides with a central point of an optical sensor of the detection unit, or even a corner point of a rectangular detection space which coincides with a corresponding corner point of an optical sensor of the detection unit, in a corresponding embodiment of an optical sensor of the detection unit. When detecting the reference point a relative arrangement of the detection unit to the cooktop or to the detection space, for example an inclination and/or a parallel offset of the detection unit to the cooktop, can be considered. Such an orientation or centering of the detection unit and standardizing of the coordinates can take place, for example, before or even at the same time as the detection of the objects, or also in a previous calibration step.

Preferably, the arrangement is implemented on the basis of orthogonal coordinates, Cartesian coordinates, grid coordinates or a two-dimensional matrix. Thus the coordinates can be stored, for example, in a list and sorted on the basis of the coordinates, wherein for example a two-dimensional matrix is oriented on the basis of coordinates of an x-axis and y-axis and the centroids of the objects stored on the basis of the corresponding coordinates in the matrix so that a virtual arrangement of the detected objects is provided. The assignment can correspondingly be implemented on the basis of the virtual arrangement, wherein each identifier is assigned to one respective matrix cell and these are optionally sorted into columns or rows. Detected operating states can thus be assigned to a corresponding identifier and a cooking zone linked thereto, for example by means of a look-up table which can be implemented in control logic.

The coordinates can be standardized on the basis of a predetermined tolerance range. Thus, for example, coordinates with a tolerance of between approximately 5 percent and 10 percent of the difference between maximum and minimum ascertained coordinates can be treated identically. If coordinates for centroids, for example, have a y-value which is between 10 and 50, the difference in the y-value is 40 and a tolerance of 2 to 4 can be provided. The centroids with a y-value of between 45 and 49 are correspondingly regarded as identical and can be correspondingly processed or stored, for example, with a predetermined value.

The arrangement and assignment of the cooking zones and identifiers can be implemented in different ways. In a preferred embodiment, more than two cooking zones are present in the cooktop and more than two identifiers are present in the control panel, wherein starting from a cooking zone, with the centroid with predetermined coordinates, direction vectors are formed to the respective centroids of the remaining cooking zones and starting from an identifier, with the centroid with predetermined coordinates, direction vectors are formed to the respective centroids of the remaining identifiers. The identifiers are assigned to the cooking zones on the basis of the arrangement, when a congruence is present of the direction vectors of the cooking zones to the direction vectors of the identifiers.

The predetermined coordinates can define, for example, the centroid of an object with the lowest x-values and y-values so that starting from this point vectors are formed to the remaining centroids. In this manner, two patterns are created, namely a pattern for the vectors of the cooking zones and a pattern for the identifiers or indicators, which are subsequently monitored for an overlap or congruence. In order to simplify this, it can also be provided that the vectors are standardized so that the vectors have a uniform size and in each case differ only in terms of direction. When monitoring the congruence it can further be provided that a congruence can be assumed even with slight deviations, wherein for example a tolerance range or a threshold value for a deviation of the vector angle can be considered during the monitoring.

If a congruence is present, the assignment of the identifiers to the respective cooking zones can be implemented on the basis of the corresponding arrangement of the cooking zones.

In a further embodiment, which is optionally provided, when a congruence cannot be determined an even number of four or more respective cooking zones are present in the cooktop and four or more identifiers are present in the control panel, wherein it is determined on the basis of the coordinates of the centroids of the identifiers whether the identifiers are arranged in a linear manner and whether the identifiers are oriented perpendicular or parallel to a longitudinal axis defined by the cooking zones, wherein the assignment of the identifiers to the respective cooking zones is implemented on the basis of the determined arrangement of the identifiers.

A linear arrangement can be assumed, for example, when the coordinates of the centroids of the identifiers have y-values or x-values which do not differ from one another, optionally by considering an above-described tolerance range. The longitudinal axis can also be defined by the number of cooking zones being greater in one direction, for example when the cooking zones are arranged in rows and columns. Thus a greater number of cooking zones in the rows than in the columns can define a longitudinal direction along the rows or along an x-axis and a relative arrangement of the identifiers to the longitudinal axis can be determined. The assignment can then be implemented, for example, automatically on the basis of assignments established for the arrangement.

Thus with a perpendicular arrangement of the identifiers, the cooking zones can be grouped on the basis of common y-coordinates of the corresponding centroids and the groups arranged in descending order according to the y-coordinate, wherein the cooking zones of the group are arranged in ascending order, and within the group, according to the respective x-coordinate of the corresponding centroids, and wherein starting from the respective y-coordinate the identifiers are assigned in descending order to one respective cooking zone (12) on the basis of the arrangement.

For example, in a cooktop with six cooking zones, an arrangement of the cooking zones in two rows and three columns can be provided, wherein in such a two-dimensional matrix the upper row or the row with the highest y-value forms a first group. The identifier with the highest y-value is assigned to the cooking zone from the first group which has the lowest x-value. The identifier with the next highest y-value is correspondingly assigned to the cooking zone of the first group which has the next highest x-value and this process is repeated for the first group and then the second group until all of the identifiers are assigned to one respective cooking zone.

Alternatively, with a parallel arrangement of the identifiers the cooking zones can be grouped on the basis of common x-coordinates of the corresponding centroids and the groups are arranged in ascending order according to the x-coordinate, wherein the cooking zones of the group are arranged in descending order, and within the group, according to the respective y-coordinate of the corresponding centroids, and wherein starting from the respective x-coordinate the identifiers are assigned in ascending order to one respective cooking zone on the basis of the arrangement.

In other words, in this embodiment groups are formed according to columns, wherein in such a two-dimensional matrix the first column or the column with the lowest x-value forms a first group. The identifier with the lowest x-value is correspondingly assigned to the cooking zone from the first group which has the highest y-value. The identifier with the next highest x-value is correspondingly assigned to the cooking zone from the first group which has the next highest y-value and this process is repeated for the first group and then the second and third group until all of the identifiers are assigned to one respective cooking zone.

Additionally or alternatively, position information of one respective cooking zone relative to at least one further cooking zone can also be detected for each identifier and the assignment is implemented on the basis of the position information.

For example, a symbol which permits an unambiguous assignment of the identifiers to the respective cooking zones can be provided next to each identifier or control element. Thus the symbol can have, for example, a number of objects which corresponds to the number of cooking zones within a row or column, wherein the arrangement of the objects preferably corresponds to the arrangement of the corresponding number of cooking zones. Thus a series arrangement of three corresponding objects of the symbol can be provided for one row with three cooking zones, wherein an object which corresponds to a relative arrangement of the cooking zones is highlighted in the symbol and is detected. On the basis of the highlighted object in the symbol, therefore, an assignment of the identifier to a cooking zone which corresponds to the arrangement of the highlighted object can be implemented. If similar or identical symbols were to be provided for a plurality of rows, an unambiguous assignment could nevertheless be implemented on the basis of the y-values or x-values of the centroids of the identifiers.

In this manner, an automatic assignment of the identifiers to the respective cooking zones can be implemented so that the assignment is implemented on the basis of the detected position information which is provided by the symbols. Alternatively, the assignment can be implemented within the groups but also assisted by the position information or an implemented assignment can be confirmed thereby.

In a further embodiment, which is optionally provided, when a congruence cannot be determined and/or a linear arrangement of the identifiers and/or position information are not present, an assignment can be implemented on the basis of selectively placed cooking vessels and selectively set operating states. Thus it is possible to detect a cooking vessel on a cooking zone and an active operating state of an identifier, wherein the assignment of the identifier to one respective cooking zone is implemented on the basis of the detected cooking vessel, the arrangement and the detected operating state, wherein the assignment is preferably implemented successively for each identifier by placing the cooking vessel on one respective cooking zone and activating the operating state of the corresponding identifier.

For example, a user can initially place a cooking vessel on a cooking zone and set a heat setting by means of the corresponding identifier or control element, wherein this process is displayed and the identifier is assigned to the corresponding cooking zone. Then a further cooking vessel can be activated on a different cooking zone and a further corresponding identifier activated or the already present cooking vessel can be placed on the other cooking zone. This process is repeated until each identifier is assigned to one respective cooking zone.

It can also be provided that a plurality of cooking vessels, for example two thereof, are located at the same time on the cooktop, wherein an algorithm undertakes the assignment on the basis of stored arrangements and a probability calculation or logic. For example, in the case of six cooking zones and two rows, a cooking zone in the bottom row and at the left-hand end and a cooking zone in the top row and at the right-hand end, i.e. at opposing ends of a diagonal of the cooking zones, can be occupied by one respective cooking vessel, according to which the assignment for all of the cooking zones is implemented automatically on the basis of the detected sequence and logic of the activated identifiers.

If no automatic assignment is possible, this can be assisted by a user input. Correspondingly, arrangement information can be displayed on a display and/or transmitted to an external appliance and assignment information and/or position information are received by the input from a user, wherein the assignment is implemented on the basis of the received assignment information and/or position information.

For example, a detected image or a video image can be displayed by means of an app on a terminal device of the user, such as a smart device, wherein the identifiers and cooktops are identified, for example, by different colors in the image. The first identifier or the first control element can be optionally highlighted, for example by flashing, so that the user is prompted to select a corresponding cooking zone which is assigned to the identifier. The user, however, can also select on their own initiative an identifier and a corresponding cooking zone in order to form a pair and to permit a corresponding assignment. This process is repeated until one respective cooking zone has been selected for each identifier and a corresponding assignment has taken place.

In order to improve the validity of the assignment of the above assignment options, a monitoring of the assignment can also be provided after an implemented assignment. The monitoring can take place on the basis of an acoustic signal, a representation on a display and/or on the basis of transmitting assignment information and/or arrangement information to an external appliance.

For example, an implemented assignment on the basis of a selective illumination of a cooking zone and a corresponding identifier can be provided successively for each cooking zone-identifier pair. Preferably, the user is prompted, however, to validate and enable the learned assignment, wherein this can take place by transmitting corresponding data and inputs, as described above. Thus a validation can be provided, for example, by a confirmation and optionally an adjustment within an app of a smart device or even by interaction by means of a voice interface.

According to a further aspect, the present invention relates to a control apparatus for optical ascertainment of an operating state of a cooktop, the control apparatus being designed to carry out the above method.

Advantages and features which are described relative to the method according to the invention—if applicable—correspondingly apply to the control apparatus according to the invention and vice versa.

The control apparatus can have a detection unit for optically detecting objects within a detection space and an evaluation unit for evaluating the detected objects and for recognizing cooking zones of a cooktop encompassed by the detection space and identifiers of a control panel encompassed by the detection space on the basis of optically detected properties of the objects. The evaluation unit is designed to determine a centroid for each detected object and to arrange the cooking zones and identifiers on the basis of detected coordinates of the respective centroids in the detection space and to assign the identifiers to one respective cooking zone on the basis of the arrangement, wherein the detection unit and the evaluation unit are designed to ascertain an operating state for at least one cooking zone on the basis of a detected unambiguous feature of one respective assigned identifier.

The control apparatus can be integrated in an extractor hood or configured as a module which can be fastened to an extractor hood and comprises an interface for transmitting data, preferably wirelessly, between the control apparatus and an extractor hood, for example in the form of a communication unit. The module can be integrated, for example, in an extractor hood.

Alternatively, it is also possible that the control apparatus represents a module which is arranged separately from an extractor apparatus, such as an extractor hood, and preferably is connected to the extractor apparatus via a wireless communication connection. In this case, the communication can take place between the control apparatus and an extractor apparatus, for example, directly. The connection(s) of the control apparatus to the extractor apparatus can be wired connection(s) or wireless connection(s).

Moreover, the control apparatus can be arranged at a similar height to an extractor hood above the worktop and preferably the cooktop. The recognition of objects and/or gestures is possible by means of the control apparatus.

Preferably, the user interacts with the extractor hood by gestures. The control of the cooktop and other networked appliances can take place via a control panel which is preferably located in the detection range of the control apparatus.

The detection unit also preferably comprises at least one camera, a control monitoring system and/or at least one sensor. Preferably, the camera is a depth imaging camera and/or infrared camera. Additionally, the camera can also be designed for recording videos. The sensors can comprise, for example, microphone arrays for assisting the detection of the position of the user and/or infrared sensors for determining temperatures and/or densities. The control monitoring system of the detection unit preferably represents a monitoring unit which monitors control instructions from a controller of the extractor apparatus. As a result, for example, the set power level of the extractor apparatus can be detected in addition to the ascertained operating states of the cooktop.

A control logic can also be stored in the evaluation unit, as well as a buffer for displaying the detected objects and operating states, so that an evaluation and assignment can be assisted.

Moreover, a prediction unit and a control unit can be provided in the control apparatus, whereby different processes in the cooktop can be monitored and anticipated, even before specific events occur. A control signal and/or regulating signal, for example for a coupled extractor apparatus, preferably an extractor hood, and/or a notice or warning signal can also be output by means of the control unit.

According to a further aspect, the present invention relates to a computer program product which is stored on a non-volatile storage medium and contains computer-readable instructions which are designed to carry out the above method when executed by a processor. Thus the units of the control apparatus can also be at least partially implemented as a program.

Additionally, the units of the control apparatus can be at least partially combined. Moreover, units of the control apparatus can be at least partially formed by units of one of the household appliances. For example, at least one part of the detection unit or the control unit can be formed by units on an extractor hood.

BRIEF DESCRIPTION OF THE DRAWINGS

The present invention is explained once again hereinafter in more detail with reference to the accompanying drawings. In the drawings.

DETAILED DESCRIPTION OF EXEMPLARY EMBODIMENTS OF THE PRESENT INVENTION

Figure 1:
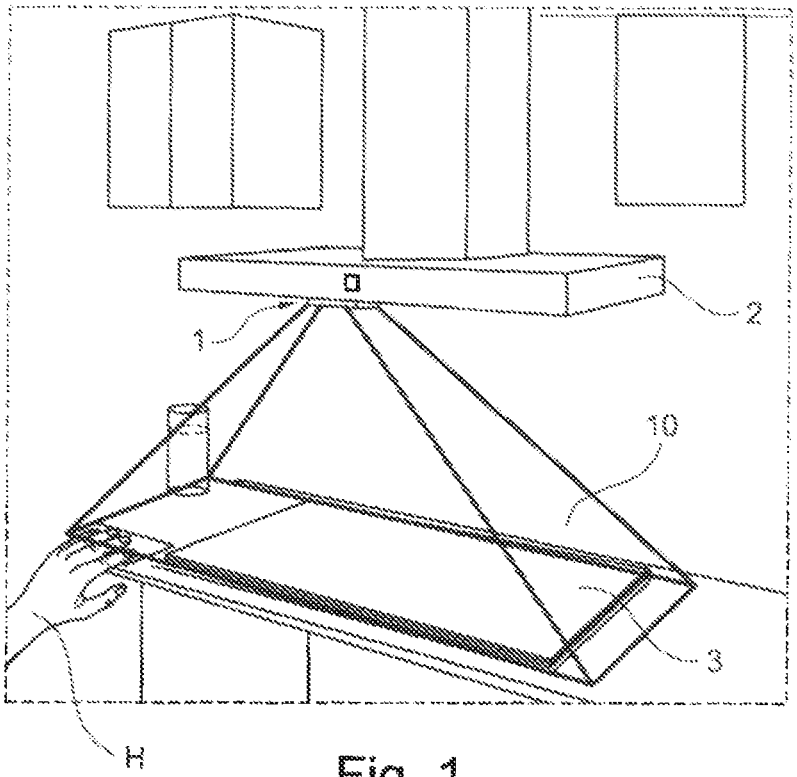
FIG. 1: shows a schematic view of an embodiment of the control apparatus according to the invention in a cooking system.
Figure 2:
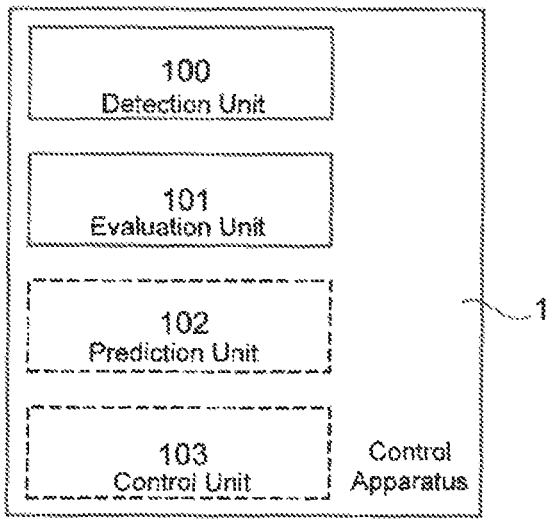
FIG. 2: shows a schematic block diagram of the units of an embodiment of the control apparatus.

The method according to the invention can be carried out, for example, with a control apparatus 1 shown in FIGS. 1 and 2, wherein the control apparatus 1 is preferably integrated in the extractor hood 2 and wherein a detection unit 100 of the control apparatus 1 comprises a detection range or detection space 10, a cooktop 3 and a control panel being arranged therein. The control panel is operated according to FIG. 1 by just one hand H. A heat setting for a cooking zone can be correspondingly set and adjusted via the control panel, wherein the detection unit 100 ascertains the set heat setting and optionally also a movement of the hand. For example, to this end the detection unit 100 can contain a camera which detects the set heat setting(s) on the basis of unambiguous features and assigns them to one respective cooking zone, as is described hereinafter relative to FIGS. 3 to 7.

In this manner, decision criteria which relate to an operating state such as a set heat setting of the respective cooking zone and optionally the movement of an object, for example a hand H of the user in the region of a cooking zone, are detected by the detection unit 100. Thus cooking processes can be monitored and/or anticipated on the basis of an evaluation in an evaluation unit 101. In order to determine whether specific events can occur due to decision criteria, if required a prediction unit 102 and a control unit 103 can be provided for the output of a notice or a warning signal. In this manner, the intentions of the user to act and sequences of the cooking process can be interpreted and predicted in part by means of machine object recognition and expedient measures initiated.

Figure 3:
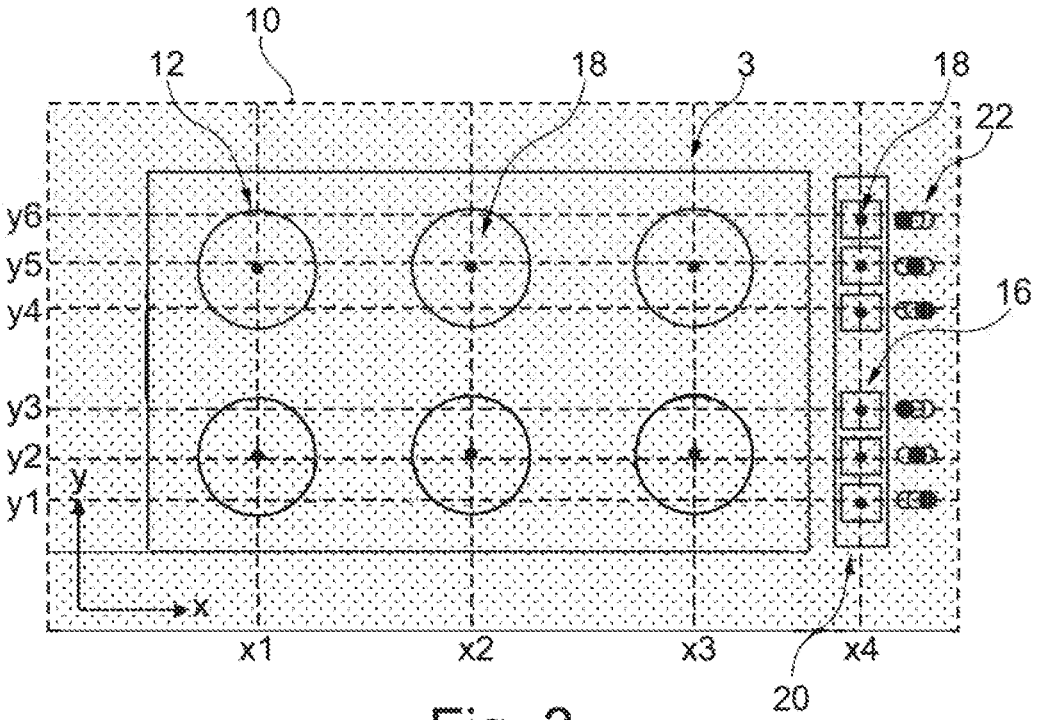
FIG. 3: shows a schematic view of an arrangement and assignment of cooking zones and identifiers on the basis of a perpendicular arrangement of the identifiers.

The arrangement and assignment of the cooking zones and identifiers can be implemented in different ways, as is shown in FIGS. 3 to 7 in preferred embodiments. In FIG. 3 a cooktop 3 with six cooking zones 12 which are arranged in rows and columns is correspondingly shown. A control panel 20 with a corresponding number of identifiers or control elements 16 is also provided for setting the operating states of the respective cooking zones 12, for example a heat setting. The cooktop 3 and the control panel 20 are located in this case inside a detection space 10 which is displayed or detected by a detection unit and identified by the border in dashed lines. The detection space 10 is correspondingly dimensioned such that the objects which are relevant for the optical detection are located in the detection space 10, wherein the detection unit is preferably attached to an extractor hood or integrated therein, for example as part of a control apparatus and/or a module.

In the detection space 10 the objects are recognized by means of object recognition algorithms, for example on the basis of contrast changes and the presence of specific shapes or straight or continuous and/or curved lines and predetermined size ranges. The detection unit is designed in this case to divide the detection space 10 into coordinates, as is implemented in the present case on the basis of orthogonal x-coordinates and y-coordinates. For each object or each cooking zone 12 and each indicator or each control element 16 a central point or centroid 18 is determined on the basis of the x-coordinates and y-coordinates of an edge region of the object and the corresponding coordinates are displayed for each centroid 18.

In this exemplary embodiment, the cooking zones 12 are thus sorted on the basis of the centroids 18 x1, y5; x1, y2; x2, y5; x2, y2; x3, y5; and x3, y2 and correspondingly arranged in a list in the form of a two-dimensional matrix. Moreover, the control elements 16 are sorted on the basis of the centroids 18 x4, y6; x4, y5; x4, y4; x4, y3; x4, y2; and x4; y1 and correspondingly arranged in the matrix.

In this example, the control elements 16 or the identifiers are arranged in a linear manner and namely perpendicular to the longitudinal axis or longitudinal direction of the cooking zones 12 and the cooktop 3, wherein the longitudinal axis is defined by the number of cooking zones 12 along the x-axis being greater than the corresponding number along the y-axis. In other words, a greater number of cooking zones 12 is present in the rows than in the columns and a longitudinal direction is correspondingly defined by the orientation of the rows.

The perpendicular arrangement of the control elements 16 relative to the cooking zones 12 is also determined by the identifiers or the control elements 16 having centroids 18 with x-coordinates which do not differ from one another, wherein an above-described tolerance range is taken into consideration. The control elements 16 are grouped in this case on the basis of the y-values of the cooking zones 12 and namely according to common y-coordinates of the corresponding centroids 18, wherein the groups are arranged in descending order according to the y-coordinate. In other words, in such a two-dimensional matrix the upper row or the row with the highest y-value forms a first group. The identifier or the control element 16 with the highest y-value is assigned to the cooking zone 12 from the first group which has the lowest x-value. The control element 16 with the next highest y-value is correspondingly assigned to the cooking zone 12 from the first group which has the next highest x-value and this process is repeated for the first group and then the second group until all of the identifiers are assigned to one respective cooking zone 12.

In this manner the upper cooking zones 12 with the common y-value of y=5 are sorted as the first group and the lower cooking zones 12 with the common y-value of y=2 are sorted as the second group. The identifiers or the control elements 16 are correspondingly sorted into groups, wherein the number of groups corresponds to the number of different y-values of the cooking zones 12 and the number of the respective control elements 16 per group correspondingly comprises the number of control elements 16 divided by the number of groups.

In other words, the upper three control elements 16 are sorted as the first group and the lower three control elements 16 are sorted as the second group. The cooking zones 12 of the group are arranged in ascending order, and within the group, according to the respective x-coordinate of the corresponding centroids 18, wherein starting from the respective y-coordinate the identifiers or the control elements 16 are assigned in descending order to one respective cooking zone 12 on the basis of the arrangement. Correspondingly, an assignment takes place, wherein the control elements 16 with the centroids 18 x4, y6; x4, y5; x4, y4; x4, y3; x4, y2; and x4, y1 are assigned to the cooking zones 12 x1, y5; x2, y5; x3, y5; x1, y2; x2, y2; and x3, y2.

Moreover, position information 22 in the form of a symbol is provided next to each control element 16, the symbol indicating for each control element 16 information of one respective cooking zone 12 relative to two further cooking zones 12 of the corresponding group and thus permitting the assignment to be assisted. The symbol in the present case is printed on the control panel 20 but optionally, for example, can also be engraved or adhesively bonded. Thus each symbol corresponding to the shape and number of cooking zones 12 comprises three circles, wherein for the control element 16 a corresponding circle is highlighted, as is shown by way of example by the solid area of a circle, and whereby a relative arrangement of a corresponding cooking zone 12 can be recognized relative to the remaining two cooking zones 12. On the basis of the highlighted circle in the symbol, therefore, an assignment can be implemented of the identifier or the control element 16 to a cooking zone 12 which corresponds to the arrangement of the highlighted circle. Although identical symbols are provided for the two groups, nevertheless an unambiguous assignment can be made on the basis of the y-values of the centroids 18 of the control elements 16.

Figure 4:
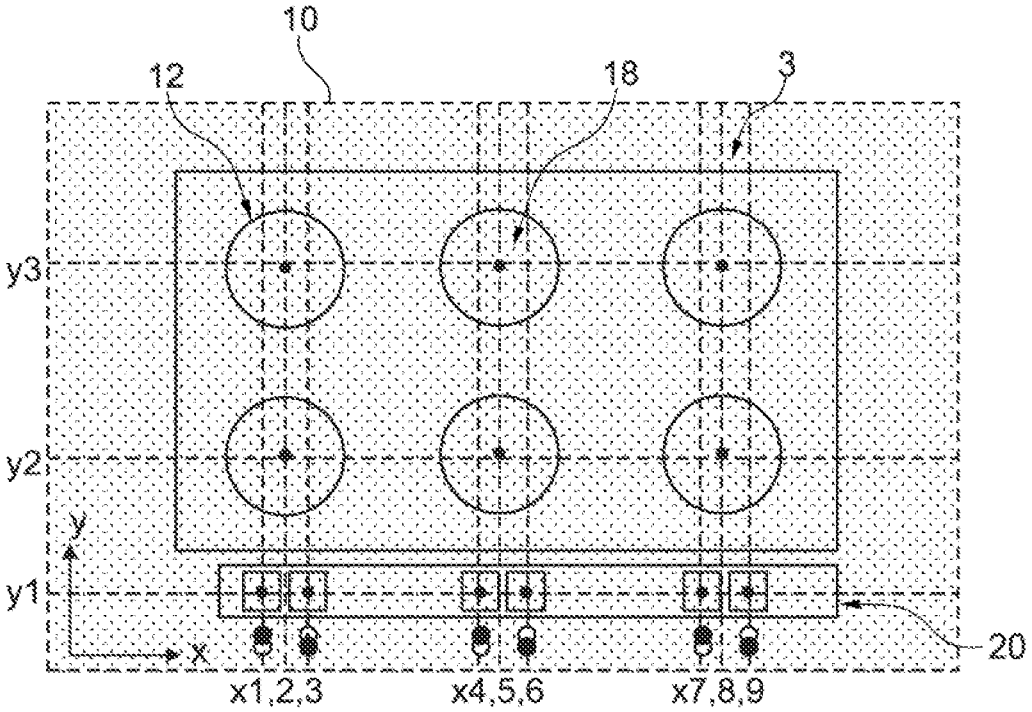
FIG. 4: shows a schematic view of an arrangement and assignment of cooking zones and identifiers on the basis of a parallel arrangement of the identifiers.

An alternative orientation of the control elements 16 is shown in FIG. 4, wherein the control elements 16 are oriented parallel to the longitudinal direction. The parallel arrangement of the control elements 16 relative to the cooking zones 12 is determined by the identifiers or the control elements 16 having centroids 18 with y-coordinates which do not differ from one another, wherein an above-described tolerance range is taken into consideration. The control elements 16 are grouped on the basis of common x-coordinates of the corresponding centroids 18 of the cooking zones 12, wherein the groups are arranged in ascending order according to the x-coordinate. The arrangement of the control elements 16 to the cooking zones 12 is implemented in the cooking zones 12 of the group in descending order, and within the group, according to the respective y-coordinate of the corresponding centroids 18, wherein starting from the respective x-coordinate the identifiers are assigned in ascending order to one respective cooking zone 12 on the basis of the arrangement.

In other words, the grouping is implemented according to columns in this embodiment, wherein in such a two-dimensional matrix the first column or the column with the lowest x-value forms a first group. The identifier with the lowest x-value is assigned to the cooking zone 12 from the first group which has the highest y-value. The identifier with the next highest x-value is correspondingly assigned to the cooking zone 12 from the first group which has the next highest y-value and this process is repeated for the first group and then the second and third group until all of the identifiers are assigned to one respective cooking zone 12.

Figure 5:
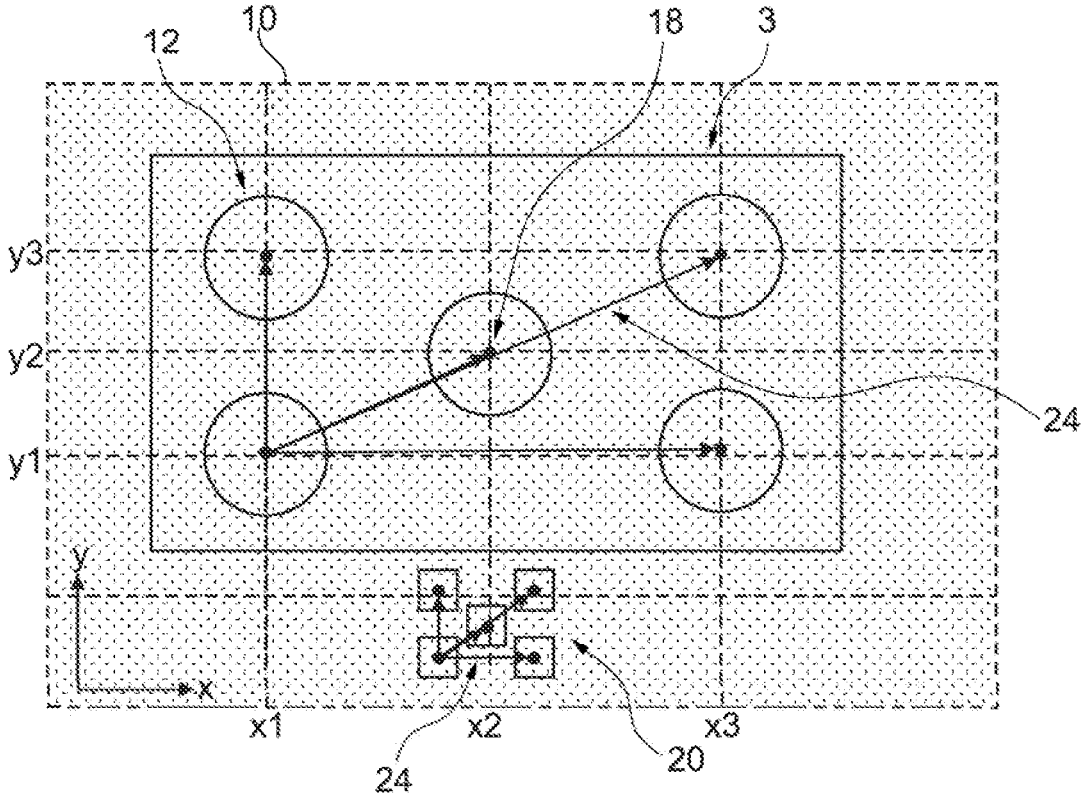
FIG. 5: shows a schematic view of an arrangement and assignment of cooking zones and identifiers on the basis of a detected pattern.

An assignment on the basis of vectors 24 or direction vectors is shown in the embodiment according to FIG. 5, wherein in the present case five cooking zones 12 are provided and neither the cooking zones 12 nor the control elements 16 are arranged in a linear manner. Moreover, no additional position information or symbols are provided next to the respective control elements.

Starting from a cooking zone with the centroid 18 with predetermined coordinates, in this case the centroid 18 with the lowest x-value and y-value, an assignment is permitted by direction vectors 24 being formed to the respective centroids 18 of the remaining cooking zones 12. This process is also carried out for the identifiers or control elements, wherein starting from an identifier with the centroid with predetermined coordinates, in this case also the centroid 18 with the lowest x-value and y-value, direction vectors are also formed to the respective centroids 18 of the remaining identifiers. The identifiers are assigned to the cooking zones 12 on the basis of the arrangement, when a congruence is present of the direction vectors 24 of the cooking zones to the direction vectors 24 of the identifiers.

In other words, on the basis of the vectors 24 a pattern is formed for the vectors 24 of the cooking zones 12 and a pattern is formed for the identifiers or indicators or control elements which are then monitored for an overlap or congruence. In order to simplify this, it can also be provided that the vectors 24 are standardized, not shown in the present case, so that the vectors have a uniform size and in each case only differ in terms of direction. When monitoring the congruence it can also be provided that a congruence can be assumed even with small deviations, wherein for example a tolerance range or a threshold value for a deviation of the vector angle can be considered during the monitoring.

If a congruence is present, the assignment of the identifiers to the respective cooking zones 12 can be implemented on the basis of the corresponding arrangement of the cooking zones 12.

Figure 6:
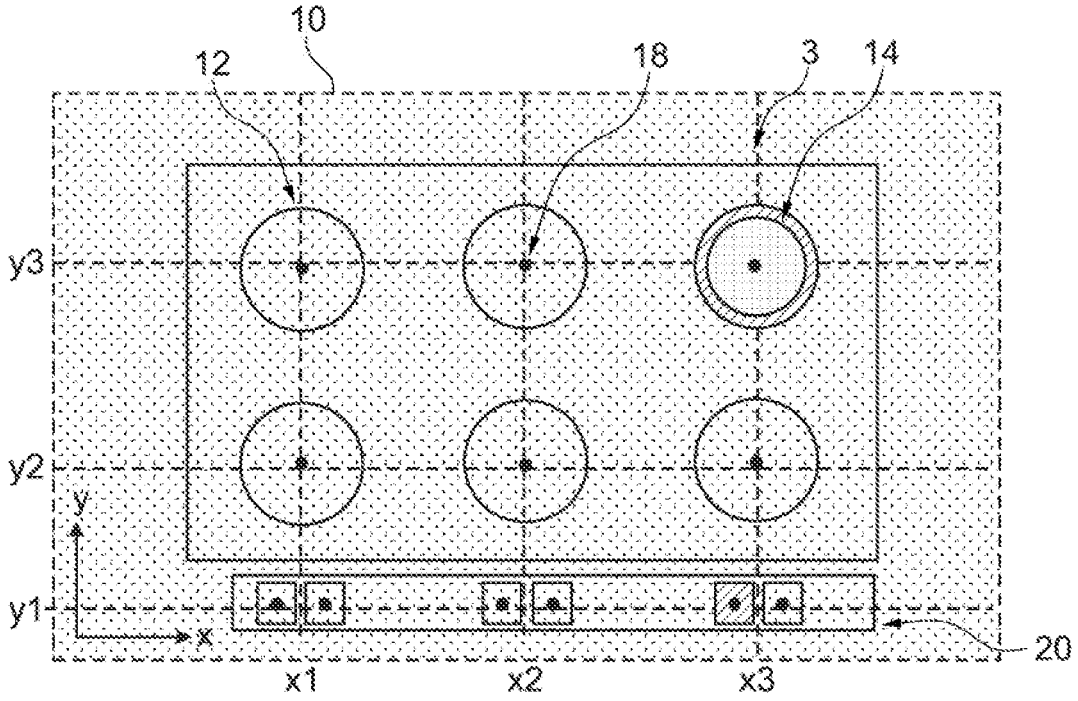
FIG. 6: shows a schematic view of an arrangement and assignment of cooking zones and identifiers on the basis of selectively placed cooking vessels and set operating states.

A further possibility for the assignment of the identifiers or control elements to the cooking zones 12 is shown in FIG. 6, wherein the assignment is implemented on the basis of a selective placing of a cooking vessel 14 on a specific cooking zone 12 and a corresponding activation of a control element for the cooking zone 12. Thus it is possible to detect a cooking vessel on a cooking zone and an active operating state of an identifier, wherein the assignment of the identifier to one respective cooking zone is implemented on the basis of the detected cooking vessel, the arrangement and the detected operating state, wherein the assignment is preferably implemented successively for each identifier by placing the cooking vessel on one respective cooking zone and activating the operating state of the corresponding identifier.

For example, a user can be prompted to place a cooking vessel 14 initially on a cooking zone 12 and set a heat setting by means of the corresponding identifier or control element, wherein this process is displayed and the identifier is assigned to the corresponding cooking zone 12. In the present example, this is shown for the cooking zone 12 with the centroid 18 with the coordinates x3, y3, wherein the left-hand operating element of the two control elements with the x-value x=3 has been activated, so that an unambiguous assignment is possible. Then the cooking vessel 14 can be placed on a different cooking zone 12 and a heat setting set for this cooking zone 12 by means of the corresponding identifier. This process is repeated until each identifier is assigned to one respective cooking zone 12, wherein an activation and specific placing is not required for the last identifier. In this manner, a semi-automatic assignment is possible, wherein the identifiers are assigned to the cooking zones 12 on the basis of the ascertained arrangement of the cooking zones 12 and the selective setting and placing of the cooking vessel 14.

Optionally, however, an assignment can also be implemented without the cooking vessel 14, wherein instead of the cooking vessel 14 an activation of a cooking zone 12 is directly detected, for example on the basis of a temperature change detected by setting the heat setting and/or a changed contrast gradient of the cooking zone 12, as is shown with the corresponding hatching in FIG. 6. To this end, for example, an infrared sensor can be provided or the detection unit can be configured as an infrared camera.

Figure 7:
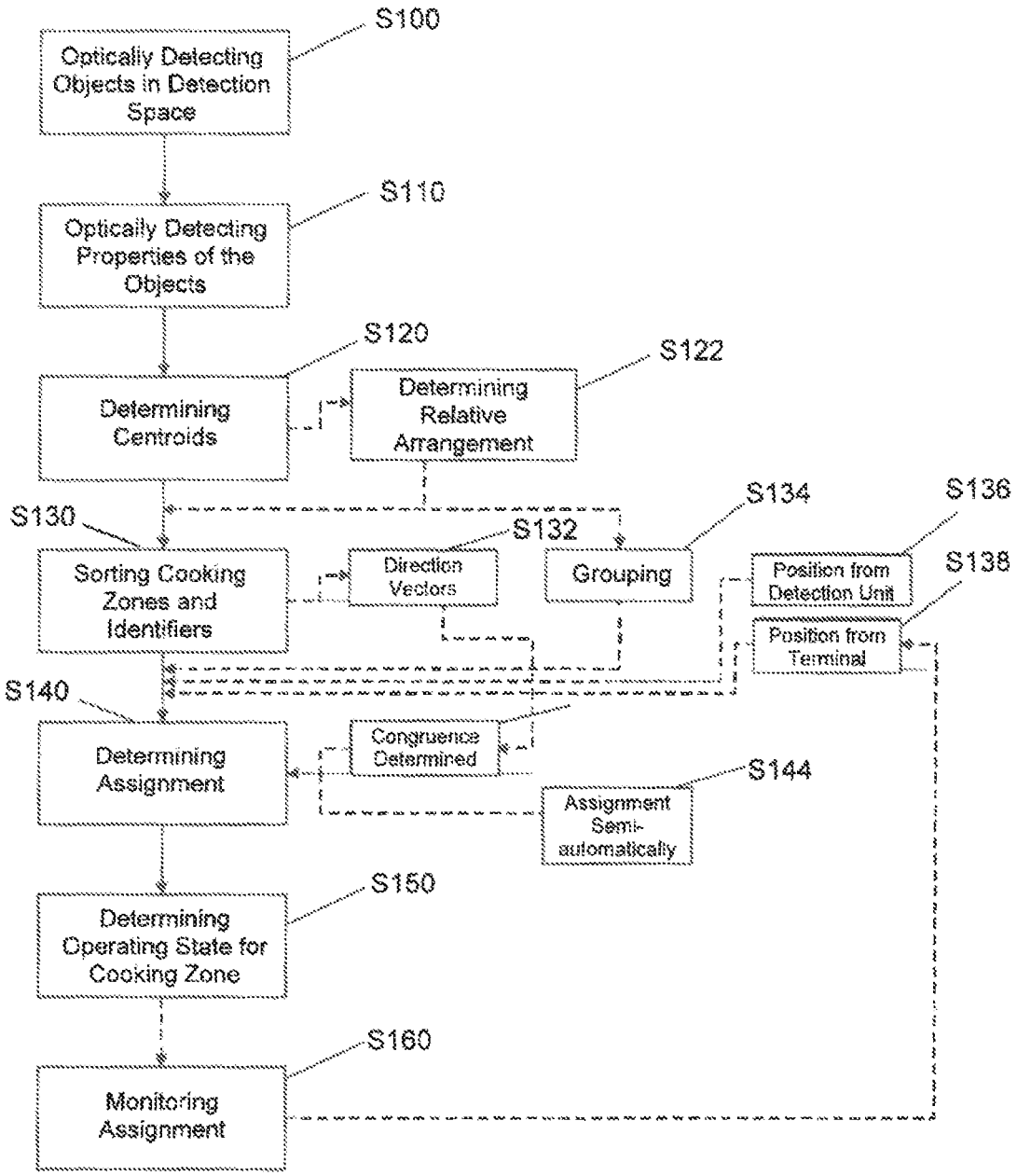
FIG. 7: shows a schematic view of an optical ascertainment of operating states with alternative assignment processes.

In FIG. 7 a schematic view of assignment processes is shown, wherein different assignment processes are optionally identified by means of the dashed arrows and/or can take place successively.

In a first step S100, objects are optically detected within a detection space, wherein the detection space comprises a cooktop with at least two cooking zones and a control panel with at least two identifiers. Then the cooking zones and the identifiers are recognized on the basis of optically detected properties of the objects (S110) and centroids are determined for each detected object (S120). Moreover, coordinates of the respective centroids are detected in the detection space and the cooking zones and identifiers are arranged or sorted on the basis of these coordinates (S130). The identifiers are then assigned to one respective cooking zone on the basis of the arrangement (S140) and then an operating state for at least one cooking zone can be ascertained (S150) on the basis of a detected unambiguous feature of one respective assigned identifier.

When determining the centroids (S120) it can optionally be provided that a linear and perpendicular or parallel arrangement of the identifiers relative to a longitudinal direction of the cooking zones is detected or recognized (S122), as for example has been described above relative to the embodiments according to FIGS. 3 and 4. Correspondingly, the identifiers and the cooking zones can also be grouped (S134) in the arrangement (S130) so that the assignment can be implemented on the basis of a grouping and a predetermined sequence of the assignment and on the basis of x-coordinates and y-coordinates and the arrangement (S130) and the assignment (S140) correspondingly assisted.

For assisting the arrangement (S130) and also the assignment of the identifiers to the cooking zones, relative position information can also be ascertained and, for example, ascertained and detected and recognized (S136) using the detection unit itself or even, for example, received from a terminal device (S138) by means of a user input. The position information can be detected or recognized, for example, using highlighting in symbols in order to permit or assist, for example within a group of cooking zones, an unambiguous assignment of an identifier to one respective cooking zone.

It can also be provided that direction vectors are formed and a pattern of the direction vectors (S132) is determined in the arrangement, after which a monitoring of a congruence of the vectors of the identifiers and the vectors of the cooking zones takes place and the assignment is implemented on the basis of the congruence or on the basis of the arrangement when a congruence is determined (S142). A corresponding example of such an assignment process is described above, for example, relative to FIG. 5.

An assignment can also be carried out on the basis of a selectively placed cooking vessel on a cooking zone and a corresponding change of the operating state or the setting of a heat setting for the corresponding cooking zone, wherein the cooking vessel and/or the cooking zone and the corresponding control element or the identifier are detected and this successively takes place for all cooking zones and identifiers, as is described above for example relative to the embodiment according to FIG. 6.

Preferably, corresponding assignment processes are implemented in an algorithm, wherein the assignment and arrangement are preferably implemented successively when a specific assignment process is not possible or fails. For example, initially an assignment can be attempted according to a vector pattern and a congruence (S132, S142) and then an assignment according to a specific linear arrangement of the identifiers and a corresponding grouping (S122, S134) when no congruence has been determined. Should an unambiguous grouping not be possible or a linear arrangement not be present, optionally an assignment can then be implemented on the basis of input position information (S136, S138) or even semi-automatically (S144) on the basis of the selective placing of a cooking vessel. Such an optional automatic process permits an unambiguous assignment of the identifiers to one respective cooking zone in different conditions and embodiments of the cooktop and the control panel, without a specific process having to be selected therefor.

In order to improve the validity of an assignment automatically implemented, a monitoring of the assignment (S160) can also be provided, which preferably is confirmed or adjusted on the basis of manual inputs, for example by input position information (S138).

The invention claimed is:

1. A method for optical ascertainment of an operating state of a cooktop, said method comprising:

optically detecting objects within a detection space which comprises the cooktop having cooking zones and a control panel having identifiers;

recognizing the cooking zones and the identifiers based on optically detected properties of the objects;

determining a centroid for each detected object and arranging the cooking zones and the identifiers based on coordinates of the centroids in the detection space;

assigning the identifiers to the cooking zones in one-to-one correspondence based on an arrangement of the cooking zone and the identifiers; and ascertaining an operating state of at least one of the cooking zones based on a detected feature of one of the identifiers assigned to the at least one of the cooking zones.

2. The method as claimed in claim 1, wherein the properties of the objects comprise at least one of a contrast, a contrast gradient, markings, boundary lines, edges and a size of the object.

3. The method as claimed in claim 1, wherein the arrangement of the objects is implemented based on orthogonal coordinates, Cartesian coordinates, grid coordinates or a two-dimensional matrix.

4. The method as claimed in claim 1, wherein the coordinates are standardized based on a predetermined tolerance range.

5. The method of claim 1, wherein the cooktop comprises more than two of the cooking zones and the control panel comprises more than two of the identifiers, the method further comprising:

starting from a cooking zone defined by a centroid with predetermined coordinates, forming direction vectors to the centroids of the remaining cooking zones; and starting from an identifier defined by a centroid with predetermined coordinates, forming direction vectors to the centroids of the remaining identifiers, with the identifiers being assigned to the cooking zones based on the arrangement of the objects, when the direction vectors of the cooking zones are congruent with the direction vectors of the identifiers.

6. The method of claim 1, wherein the cooktop comprises an even number of four or more of the cooking zones and the control panel comprises four or more of the identifiers, the method further comprising:

determining based on the coordinates of the centroids of the identifiers whether the identifiers are arranged in a linear manner and whether the identifiers are oriented perpendicular or parallel to a longitudinal axis defined by the cooking zones, and assigning the identifiers to the cooking zones based on the determined arrangement of the identifiers.

7. The method of claim 6, further comprising:

in response to determining a perpendicular arrangement of the identifiers, grouping the cooking zones based on common y-coordinates of the corresponding centroids, and arranging the groups in descending order according to the common y-coordinate, with the cooking zones being arranged, depending on the group, within the group in ascending order according to the respective x-coordinate of the corresponding centroids, and starting from the respective common y-coordinate, assigning the identifiers in descending order to one respective cooking zone based on the arrangement.

8. The method of claim 6, further comprising:

in response to determining a parallel arrangement of the identifiers, grouping the cooking zones based on common x-coordinates of the corresponding centroids, and arranging the groups in ascending order according to the common x-coordinate, with the cooking zones being arranged, depending on the group, within the group in descending order according to the respective y-coordinate of the corresponding centroids, and starting from the respective x-coordinate, assigning the identifiers in ascending order to one respective cooking zone based on the arrangement.

9. The method of claim 1, further comprising:

detecting for each identifier position information of one respective cooking zone relative to at least one further cooking zone, and assigning the identifier based on the detected position information.

10. The method of claim 1, further comprising:

detecting a cooking vessel on a respective one of the cooking zones and an active operating state of a respective one of the identifiers;

assigning the respective identifier to the respective cooking zone based on the detected cooking vessel, the arrangement and the detected operating state; and implementing the assignment for each of the identifiers by placing a cooking vessel on a corresponding cooking zone and activating the operating state of each identifier assigned to the corresponding cooking zone.

11. The method of claim 1, further comprising:

displaying arrangement information on a display or transmitting arrangement information to an external appliance, receiving assignment information or position information via an input from a user, and assigning the identifiers to the cooking zones based on the received assignment information or position information.

12. The method of claim 11, further comprising after the identifiers are assigned, monitoring the assignment based on an acoustic signal, a representation on a display or based on transmitting the assignment information or the position information to the external appliance.

13. The method of claim 1, wherein the operating state of the at least one of the cooking zones is selected from at least one of a set heat setting, a change of the heat setting, a progression of the heat setting, and a presence of residual heat.

14. The method of claim 1, wherein the feature of the assigned identifier comprises a structural feature or displayed information.

15. A control apparatus for optical ascertainment of an operating state of a cooktop, the control apparatus being configured to carry out the method of claim 1.

16. The control apparatus of claim 15, comprising:

a detection unit configured to optically detect the objects within the detection space; and an evaluation unit configured to evaluate the detected objects and to recognize the cooking zones of the cooktop encompassed by the detection space and the identifiers of the control panel encompassed by the detection space based on the optically detected properties of the objects, wherein the evaluation unit is designed configured to determine the centroid for each detected object and to arrange the cooking zones and the identifiers based on the detected coordinates of the respective centroids in the detection space and to assign the identifiers to respective ones of the cooking zones based on the arrangement of the objects, and wherein the detection unit and the evaluation unit are configured to determine the operating state for the at least one of the cooking zones based on the detected feature of a respective one of the assigned identifiers.

17. The control apparatus of claim 15, wherein the control apparatus is integrated in an extractor hood or represents a module fastened to an extractor hood and comprises an interface for transmitting data between the control apparatus and the extractor hood.

18. An extractor apparatus comprising a control apparatus as set forth in claim 15.

19. The extractor apparatus of claim 18, wherein the control apparatus is integrated into the extractor apparatus.

20. A computer program product stored on a non-volatile storage medium and containing computer-readable instructions which when loaded into a memory of a processor of a control apparatus for optical ascertainment of an operating state of a cooktop and executed by the processor, causes the control apparatus to execute the method of claim 1.

* * * * *